US008525422B2

(12) United States Patent
Lin et al.

(10) Patent No.: US 8,525,422 B2
(45) Date of Patent: Sep. 3, 2013

(54) BACKLIGHT APPARATUS

(75) Inventors: Chiu-Yuan Lin, Taipei (TW); Chih-Chieh Hu, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 446 days.

(21) Appl. No.: 12/943,932

(22) Filed: Nov. 11, 2010

(65) Prior Publication Data

US 2011/0204800 A1 Aug. 25, 2011

(30) Foreign Application Priority Data

Feb. 23, 2010 (TW) ..... 99105200 A

(51) Int. Cl.

| | |
|---|---|
| ***H05B 37/00*** | (2006.01) |
| ***H05B 39/00*** | (2006.01) |
| ***H05B 41/00*** | (2006.01) |
| *H05B 37/02* | (2006.01) |
| *H05B 39/04* | (2006.01) |
| *H05B 41/36* | (2006.01) |
| *H05B 41/16* | (2006.01) |
| *H05B 41/24* | (2006.01) |
| *G05F 1/00* | (2006.01) |

(52) U.S. Cl.

USPC ..... 315/185 R; 315/186; 315/210; 315/246; 315/294; 315/297; 315/307; 315/312

(58) Field of Classification Search

None

See application file for complete search history.

(56) References Cited

U.S. PATENT DOCUMENTS 7,183,724 B2 * 2/2007 Ball ..... 315/274

FOREIGN PATENT DOCUMENTS

CN 201335285 Y * 10/2009

* cited by examiner

*Primary Examiner* — Douglas W Owens
*Assistant Examiner* — Dedei K Hammond
(74) *Attorney, Agent, or Firm* — Winston Hsu; Scott Margo

(57) ABSTRACT

A backlight apparatus includes light emitting diode (LED) modules. Each LED module includes a first connection pin set, a second connection pin set, a driving circuit, a first LED string, and a second LED string. Each of the connection pin sets has a first and second power connection pins and a first and second ground connection pins. The first and second power connection pins are coupled to each other, and the first and second ground connection pins are coupled to each other. The first ground connection pin of the first connection pin set is coupled to the first power connection pin of the second connection pin set. The driving circuit is used to provide a driving signal. Each of the LED strings is serially connected between the second power connection pin and the second ground connection pin of each of the connection pin sets and receives the driving signal.

8 Claims, 3 Drawing Sheets

BACKLIGHT APPARATUS

CROSS-REFERENCE TO RELATED APPLICATION

This application claims the priority benefit of Taiwan application serial no. 99105200, filed on Feb. 23, 2010. The entirety of the above-mentioned patent application is hereby incorporated by reference herein and made a part of this specification.

BACKGROUND OF THE INVENTION

1. Field of the Invention

The invention relates to a backlight apparatus. More particularly, the invention relates to a light emitting diode (LED) backlight apparatus.

2. Description of Related Art

At present, a liquid crystal display (LCD) panel is often comprised of an LED which serves as a backlight apparatus. The LED backlight apparatus is designed based on different requirements. For instance, a multi-loop LED backlight apparatus is frequently required when favorable display needs to be achieved. That is to say, a plurality of LED strings are applied in such a design.

After the number of the LED strings is increased, one issue derived therefrom lies in how to evenly emit light from each of the LED strings. In the existing design of the LED backlight apparatus, each of the LED strings is driven by individual driving circuit. Luminance variation in each of the LED strings driven by the corresponding driving circuit is adjusted, such that the luminance of each of the LED strings is similar, and brightness uniformity of the backlight apparatus can be improved.

Nonetheless, a plurality of driving circuits are required in said conventional LED backlight apparatus, and therefore circuit costs are relatively high. Moreover, complicated and costly technology should be applied in order to uniformize the luminance of the LED strings by accurately adjusting the corresponding driving circuits. As such, costs of the conventional LED backlight apparatus are significantly increased.

SUMMARY OF THE INVENTION

The invention is directed to a backlight apparatus of which brightness uniformity can be effectively improved.

The invention provides a backlight apparatus including a plurality of LED modules. Each of the LED modules includes a first connection pin set, a second connection pin set, a driving circuit, a first LED string, and a second LED string. Each of the connection pin sets has a first power connection pin, a second power connection pin, a first ground connection pin, and a second ground connection pin. The first and second power connection pins are coupled to each other, and the first and second ground connection pins are coupled to each other. The first ground connection pin of the first connection pin set is coupled to the first power connection pin of the second connection pin set. The driving circuit is coupled to the first power connection pin of the first connection pin set and the first ground connection pin of the second connection pin set for providing a driving signal. Each of the LED strings is coupled between the second power connection pin and the second ground connection pin of each of the connection pin sets and receives the driving signal.

According to an embodiment of the invention, each of the LED modules further includes at least one third connection pin set and at least one third LED string. The third connection pin set has a first power connection pin, a second power connection pin, a first ground connection pin, and a second ground connection pin. The third connection pin set is coupled to a coupling path where the driving circuit is coupled to the first ground connection pin of the second connection pin set. The first power connection pin of the third connection pin set is coupled to the first ground connection pin of the second connection pin set. The first ground connection pin of the third connection pin set is coupled to the driving circuit. The third LED string is serially connected between the second power connection pin and the second ground connection pin of the third connection pin set to receive the driving signal.

According to an embodiment of the invention, the driving signal is a driving current.

According to an embodiment of the invention, the driving circuit is a direct current to direct current (DC-DC) power converter.

According to an embodiment of the invention, the DC-DC power converter includes an inductor, a semiconductor pseudo switch, a first diode, a voltage detecting circuit, and a controller. The inductor has an end that receives an input voltage. The semiconductor pseudo switch is serially connected between the other end of the inductor and a base voltage, and the semiconductor pseudo switch is controlled by a pulse width modulation (PWM) signal. An anode of the first diode is commonly coupled to the inductor and the semiconductor pseudo switch, and a cathode of the first diode generates the driving signal. The voltage detecting circuit receives the driving signal and generates an over voltage protecting signal by dividing a voltage of the driving signal. The controller receives an operating voltage, a feedback signal, the over voltage protecting signal, an enabling signal, and a dimming signal. The PWM signal is generated based on the feedback signal and the dimming signal when the enabling signal is enabled. The semiconductor pseudo switch can include a transistor switch and a MOS switch. Here, the MOS switch is applied to exemplify the invention.

According to an embodiment of the invention, the controller further stops generating the PWM signal based on the over voltage protecting signal when an over voltage effect arises in the driving circuit.

According to an embodiment of the invention, the backlight apparatus further includes a voltage generator. The voltage generator is coupled to the driving circuit for generating the operating voltage based on the input voltage.

According to an embodiment of the invention, the voltage generator includes a first current limiting resistor, a second current limiting resistor, a transistor, a voltage stabilizing capacitor, and a second diode. An end of the first current limiting resistor and an end of the second current limiting resistor commonly receive the input voltage. A control end of the transistor is coupled to the other end of the first current limiting resistor. A first end of the transistor is coupled to the other end of the second current limiting resistor. The voltage stabilizing capacitor is serially connected between a second end of the transistor and the base voltage. An anode of the second diode receives the base voltage, and a cathode of the second diode is commonly coupled to the transistor and the first current limiting resistor.

Based on the above, the connection between the driving circuit and the LED strings of the backlight apparatus is changed, such that more of the LED strings are serially connected. Thereby, the required number of the driving circuits can be reduced, and the brightness uniformity of the backlight apparatus is improved.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
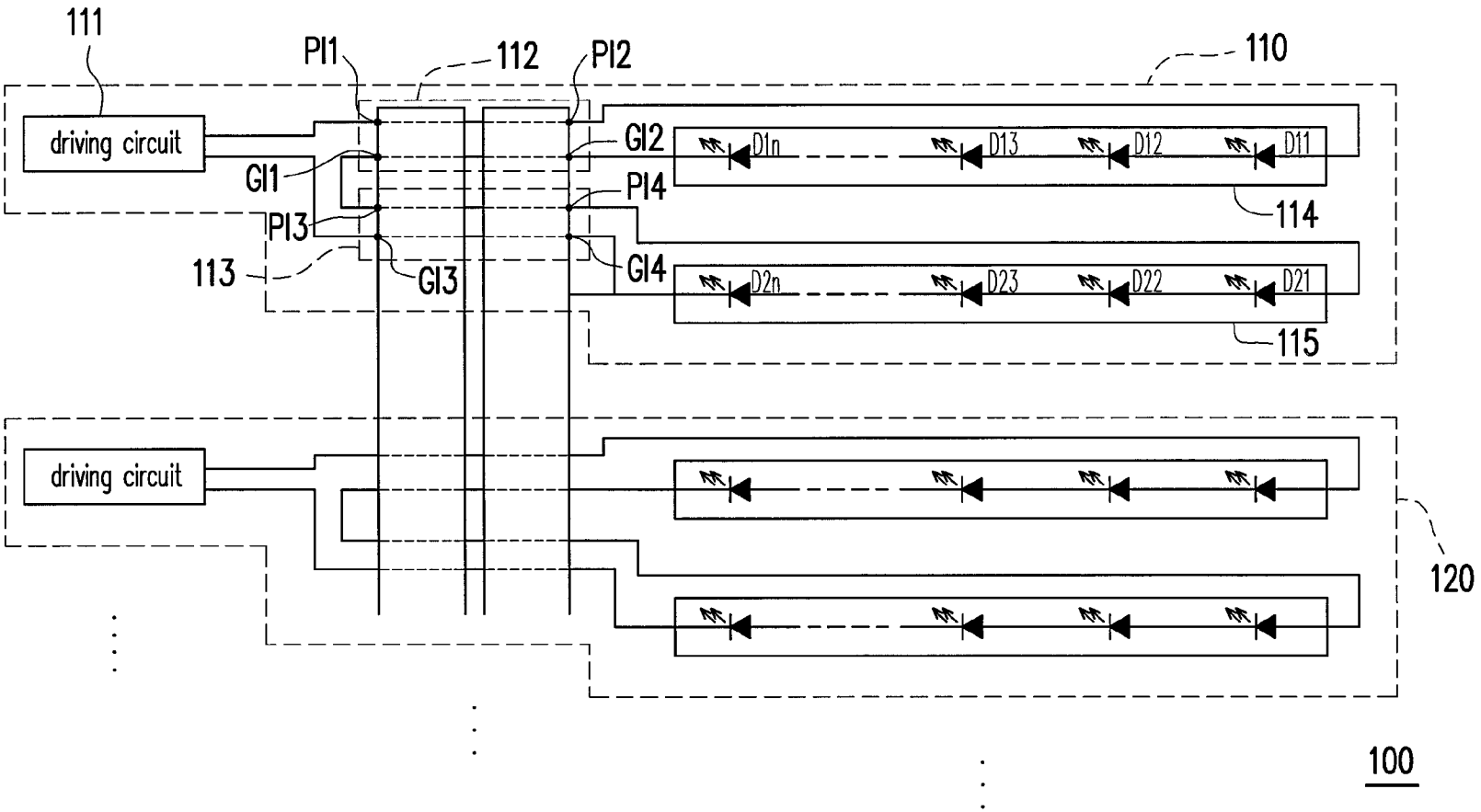
FIG. 1 is a schematic view illustrating a backlight apparatus 100 according to an embodiment of the invention.

Please refer to FIG. 1, which is a schematic view illustrating a backlight apparatus 100 according to an embodiment of the invention. The backlight apparatus 100 includes a plurality of LED modules 110 and 120. The LED module 110, which is taken for example, includes connection pin sets 112 and 113, a driving circuit 111, and LED strings 114 and 115. The connection pin set 112 has a first power connection pin PI1, a second power connection pin PI2, a first ground connection pin GI1, and a second ground connection pin GI2. In the connection pin set 112, the first power connection pin PI1 and the second power connection pin PI2 are connected (short circuit), and the first ground connection pin GI1 and the second ground connection pin GI2 are connected (short circuit). Similarly, the connection pin set 113 has a first power connection pin PI3, a second power connection pin PI4, a first ground connection pin GI3, and a second ground connection pin GI4. In the connection pin set 113, the first power connection pin PI3 and the second power connection pin PI4 are connected (short circuit), and the first ground connection pin GI3 and the second ground connection pin GI4 are connected (short circuit). On the other hand, in this embodiment, the first ground connection pin GI1 of the connection pin set 112 is directly connected to the first power connection pin PI3 of the connection pin set 113.

The driving circuit 111 is coupled to the first power connection pin PI1 of the connection pin set 112 and the first ground connection pin GI3 of the connection pin set 113. The driving circuit 111 transmits the driving signal to the LED strings 114 and 115 through the connection pin sets 112 and 113. The LED string 114 is comprised of a plurality of serially connected LEDs D11~D1N. Here, N is the number of the LEDs, and N is a positive integer. The LED string 115 is comprised of N serially connected LEDs D21~D2N. An anode of the first LED D11 in the LED string 114 is coupled to the second power connection pin PI2 of the connection pin set 112, and a cathode of the last LED D1N in the LED string 114 is coupled to the second ground connection pin GI2 of the connection pin set 112. Similarly, an anode of the first LED D21 in the LED string 115 is coupled to the second power connection pin PI4 of the connection pin set 113, and a cathode of the last LED D2N in the LED string 115 is coupled to the second ground connection pin GI4 of the connection pin set 113.

Based on the above, the driving circuit 111 is serially connected to the LED string 114 through the connection pin set 112 and further serially connected to the LED string 115 from the connection pin set 112 to the connection pin set 113, so as to form an electrical loop (the driving circuit 111—the LED string 114—the LED string 115). That is to say, the driving signal (e.g., the driving current) provided by the driving circuit 111 is transmitted to the LED string 114 through the first and second power connection pin sets PI1 and PI2 of the connection pin set 112, and the driving signal is transmitted to the LED string 115 through the first and second ground connection pins GI1 and GI2 of the connection pin set 112 and the first and second power connection pins PI3 and PI4 of the connection pin set 113. Finally, the driving signal is transmitted back to the driving circuit 111 through the first and second ground connection pins GI3 and GI4 of the connection pin set 113.

As such, the LED strings 114 and 115 receive the same driving signal that is not attenuated. Namely, the luminance of the LED strings 114 and 115 is the same.

Note that each set of driving circuits 111 can drive two LED strings 114 and 115 in this embodiment. That is to say, in the backlight apparatus 100, the number of the driving circuits is half the number of the LED strings, such that the required number of the driving circuits can be effectively reduced.

Figure 2:
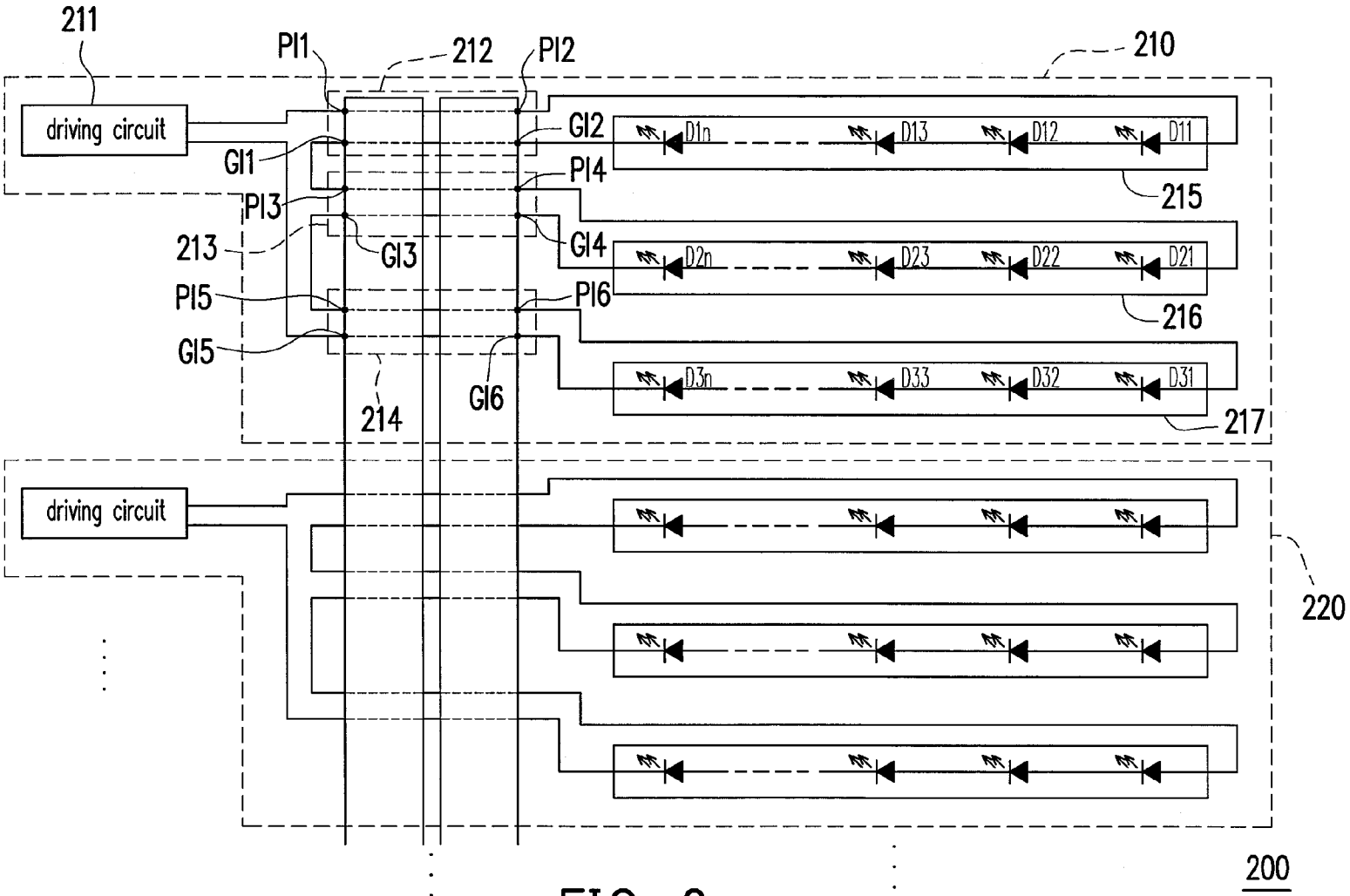
FIG. 2 is a schematic view illustrating a backlight apparatus 200 according to another embodiment of the invention.

Please refer to FIG. 2, which is a schematic view illustrating a backlight apparatus 200 according to another embodiment of the invention. The backlight apparatus 200 includes a plurality of LED modules 210 and 220. The LED module 210, which is taken for example, includes connection pin sets 212, 213, and 214, a driving circuit 211, and LED strings 215, 216, and 217. The connection pin set 212 has a first power connection pin PI1, a second power connection pin PI2, a first ground connection pin GI1, and a second ground connection pin GI2. In the connection pin set 212, the first power connection pin PI1 and the second power connection pin PI2 are connected (short circuit), and the first ground connection pin GI1 and the second ground connection pin GI2 are connected (short circuit). Similarly, the connection pin set 213 has a first power connection pin PI3, a second power connection pin PI4, a first ground connection pin GI3, and a second ground connection pin GI4. In the connection pin set 213, the first power connection pin PI3 and the second power connection pin PI4 are connected (short circuit), and the first ground connection pin GI3 and the second ground connection pin GI4 are connected (short circuit). The connection pin set 214 has a first power connection pin PI5, a second power connection pin PI6, a first ground connection pin GI5, and a second ground connection pin GI6. In the connection pin set 214, the first power connection pin PI5 and the second power connection pin PI6 are connected (short circuit), and the first ground connection pin GI5 and the second ground connection pin GI6 are connected (short circuit).

Besides, in this embodiment, the first ground connection pin GI1 of the connection pin set 212 is directly connected to the first power connection pin PI3 of the connection pin set 213, and the first ground connection pin GI3 of the connection pin set 213 is directly connected to the first power connection pin PI5 of the connection pin set 214.

The driving circuit 211 is coupled to the first power connection pin PH of the connection pin set 212 and the first ground connection pin GI5 of the connection pin set 214, and the driving circuit 211 provides the driving signal.

The LED strings 215~217 respectively include a plurality of serially connected LEDs D11~D1N, D21~D2N, and D31~D3N. The LED strings 215~217 are respectively connected to the second power connection pins PI2, PI4, and PI6 and the second ground connection pins GI2, GI4, and GI6 of the connection pin sets 212, 213, and 214.

Different from the previous embodiment, this embodiment provides one more connection pin set 214 that is coupled to a coupling path where the driving circuit 211 is coupled to the first ground connection pin GI3 of the connection pin set 213. Besides, in this embodiment, the LED string 217 is connected between the second power connection pin PI6 and the second ground connection pin GI6 of the connection pin set 214. Namely, the driving signal provided by the driving circuit 211 is transmitted to the LED string 215 through the connection pin set 212, to the LED string 216 through the connection pin set 213, to the LED string 217 through the connection pin set 214, and back to the driving circuit 211 through the second and first ground connection pins GI6 and GI5 of the connection pin set 214.

Certainly, the driving signal (e.g., the driving current) transmitted by the driving circuit 211 can be sent to the serially connected LED strings 215, 216, and 217 without being attenuated. In other words, the luminance of the LED strings 215, 216, and 217 remains consistent. Thereby, brightness uniformity of the backlight apparatus 200 can be improved. Moreover, the number of the driving circuits can be ⅓ of the number of the LED strings, which is conducive to reduction of the driving circuits and the circuit costs.

It should be mentioned that one more connection pin set can be further disposed between the connection pin set 214 and the driving circuit 211, and the driving signal provided by the driving circuit 211 is expanded to pass through the four-stage serially connected LED strings. As such, the brightness uniformity of the backlight apparatus 200 is further enhanced, while the circuit costs can be further lowered down.

Figure 3:
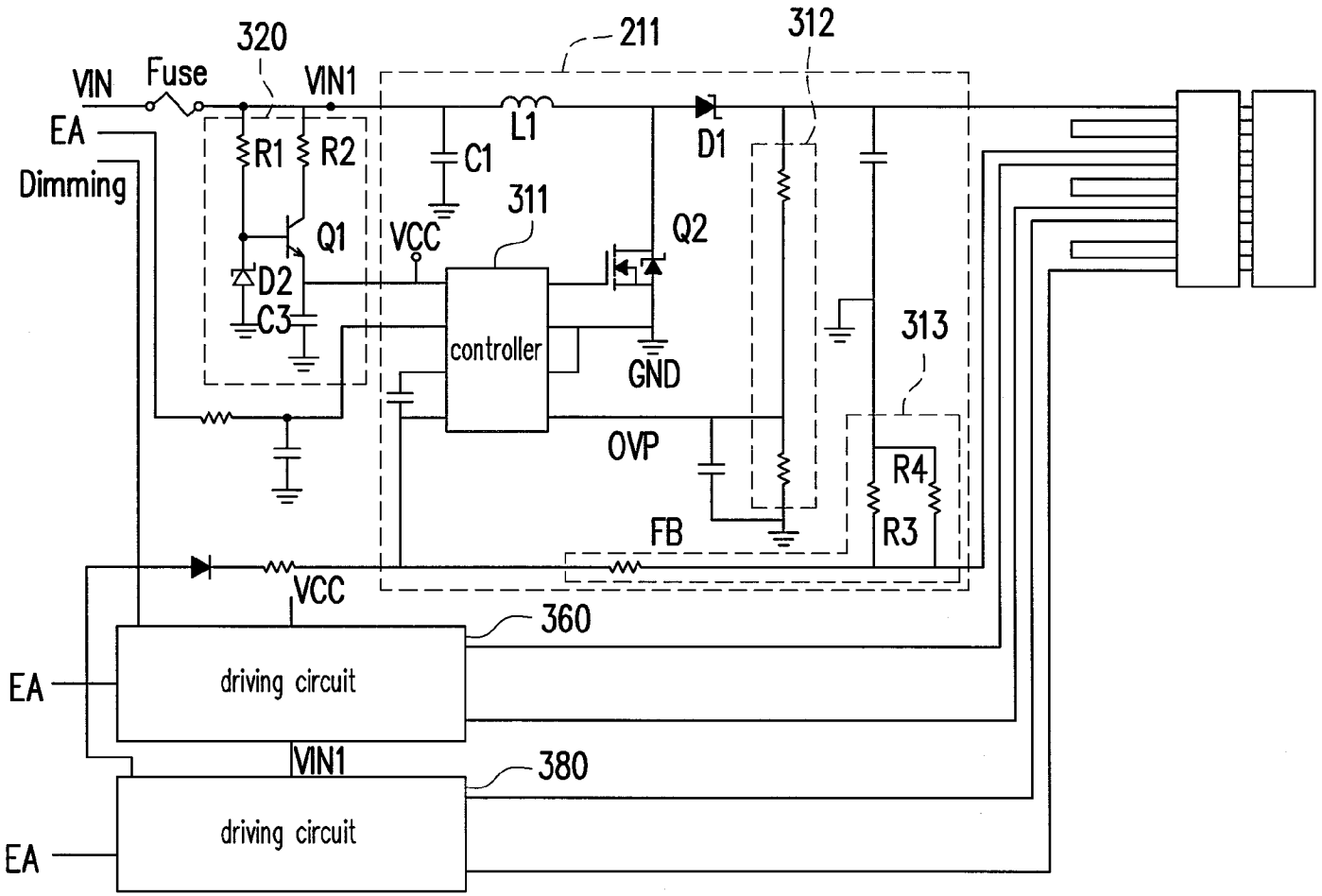
FIG. 3 illustrates implementation of a driving circuit 211 according to an embodiment of the invention.

Please refer to FIG. 3, which illustrates implementation of the driving circuit 211 according to an embodiment of the invention. Here, the driving circuit 211 includes an inductor L1, a semiconductor pseudo switch Q2, a diode D1, an over voltage protecting circuit 312, a feedback circuit 313, and a controller 311. The inductor L1 has an end that receives an input voltage VIN1. The semiconductor pseudo switch Q2 is serially connected between the other end of the inductor L1 and a base voltage GND, and the semiconductor pseudo switch Q2 is controlled by a PWM signal from the controller 311. An anode of the diode D1 is commonly coupled to the inductor L1 and the semiconductor pseudo switch Q2, and a cathode of the diode D1 generates the driving signal. The over voltage protecting circuit 312 receives the driving signal and generates an over voltage protecting signal OVP by dividing a voltage of the driving signal. Here, the feedback circuit 313 includes feedback detecting resistors R3 and R4. The controller 311 receives an operating voltage VCC, the over voltage protecting signal OVP, a feedback signal FB, a dimming signal Dimming, and an enabling signal EA. When the enabling signal EA is enabled, the controller 311 generates the PWM signal based on the feedback signal FB and the dimming signal Dimming. Besides, the controller 311 stops generating the PWM signal based on the over voltage protecting signal OVP when an over voltage effect arises in the driving circuit 211.

In this embodiment, the operating voltage VCC is generated by the voltage generator 320 according to the input voltage VIN1. The voltage generator 320 is coupled to the driving circuit 211, and the voltage generator 320 includes current limiting resistors R1 and R2, a transistor Q1, a voltage stabilizing capacitor C3, and a diode D2. An end of the current limiting resistor R1 and an end of the current limiting resistor R2 commonly receive the input voltage VIN1. A control end of the transistor Q1 is coupled to the other end of the current limiting resistor R1. A first end of the transistor Q1 is coupled to the other end of the current limiting resistor R2. The voltage stabilizing capacitor C3 is serially connected between a second end of the transistor Q1 and the base voltage GND. An anode of the diode D2 receives the base voltage GND, and a cathode of the diode D2 is commonly coupled to the transistor Q1 and the current limiting resistor R1. A voltage VIN is serially connected to a fuse Fuse to generate the input voltage VIN1 at the other end of the fuse Fuse.

Note that the driving circuits 360 and 380 and the driving circuit 211 are implemented in the same manner to generate the driving signal with favorable uniformity, and the implementation details are not described hereinafter.

In light of the foregoing, the connection of connection pins in the connection sets is modified in this invention, so as to change the number of the LED strings which are serially connected to the driving circuit. Thereby, the driving signal provided by a single driving circuit can be continuously and serially connected to the LED strings, so as to improve the brightness uniformity of the backlight apparatus. Moreover, the required number of the driving circuits and the circuit costs can be effectively reduced.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A backlight apparatus comprising:

a plurality of light emitting diode modules, each of the light emitting diode modules comprising:

a first connection pin set and a second connection pin set, each of the connection pin sets comprising a first power connection pin, a second power connection pin, a first ground connection pin, and a second ground connection pin, the first power connection pin being coupled to the second power connection pin, the first ground connection pin being coupled to the second ground connection pin, wherein the first ground connection pin of the first connection pin set is coupled to the first power connection pin of the second connection pin set;

a driving circuit coupled to the first power connection pin of the first connection pin set and the first ground connection pin of the second connection pin set for providing a driving signal; and a first light emitting diode string and a second light emitting diode string, each of the light emitting diode strings being serially connected between the second power connection pin and the second ground connection pin of each of the connection pin sets and receiving the driving signal, wherein the driving circuit is a direct current to direct current power converter, and the direct current to direct current power converter comprises:

an inductor, an end of the inductor receiving an input voltage;

a semiconductor pseudo switch serially connected between the other end of the inductor and a base voltage, the semiconductor pseudo switch being controlled by a pulse width modulation signal;

a first diode, an anode of the first diode being commonly coupled to the inductor and the semiconductor pseudo switch, a cathode of the first diode generating the driving signal;

a voltage detecting circuit receiving the driving signal and generating an over voltage protecting signal by dividing a voltage of the driving signal; and a controller receiving an operating voltage, a feedback signal, the over voltage protecting signal, an enabling signal, and a dimming signal, wherein the controller generates the pulse width modulation signal based on the feedback signal and the dimming signal when the enabling signal is enabled.

2. The backlight apparatus as claimed in claim 1, wherein each of the light emitting diode modules further comprises:

at least one third connection pin set having a first power connection pin, a second power connection pin, a first ground connection pin, and a second ground connection pin, the at least one third connection pin set being coupled to a coupling path where the driving circuit is coupled to the first ground connection pin of the second connection pin set, wherein the first power connection pin of the at least one third connection pin set is coupled to the first ground connection pin of the second connection pin set, and the first ground connection pin of the at least one third connection pin set is coupled to the driving circuit; and at least one third light emitting diode string being serially connected between the second power connection pin and the second ground connection pin of the at least one third connection pin set for receiving the driving signal.

3. The backlight apparatus as claimed in claim 1, wherein the driving signal is a driving current.

4. The backlight apparatus as claimed in claim 1, wherein the controller further stops generating the pulse width modulation signal based on the over voltage protecting signal when an over voltage effect arises in the driving circuit.

5. The backlight apparatus as claimed in claim 1, wherein the semiconductor pseudo switch is a transistor switch.

6. The backlight apparatus as claimed in claim 1, wherein the semiconductor pseudo switch is an MOS switch.

7. The backlight apparatus as claimed in claim 1, further comprising:

a voltage generator coupled to the driving circuit for generating the operating voltage based on the input voltage.

8. The backlight apparatus as claimed in claim 7, wherein the voltage generator comprises:

a first current limiting resistor, an end of the first current limiting resistor receiving the input voltage;

a second current limiting resistor, an end of the second current limiting resistor receiving the input voltage;

a transistor, a control end of the transistor being coupled to the other end of the first current limiting resistor, a first end of the transistor being coupled to the other end of the second current limiting resistor;

a voltage stabilizing capacitor serially connected between a second end of the transistor and the base voltage; and a second diode, an anode of the second diode receiving the base voltage, a cathode of the second diode being commonly coupled to the transistor and the first current limiting resistor.

* * * * *